US006520894B1

(12) United States Patent
Mesloh

(10) Patent No.: US 6,520,894 B1
(45) Date of Patent: Feb. 18, 2003

(54) WORKOUT BROWSING STAND

(75) Inventor: Robert Henry Mesloh, Parsippany, NJ (US)

(73) Assignee: Robert Mesloh, Parsippany, NJ (US)

( * ) Notice: Subject to any disclaimer, the term of this patent is extended or adjusted under 35 U.S.C. 154(b) by 134 days.

(21) Appl. No.: 09/804,043

(22) Filed: Mar. 12, 2001

(51) Int. Cl.[7] ..... A47B 23/00
(52) U.S. Cl. ..... 482/148; 248/441.1
(58) Field of Search ..... 248/441.1, 444.1; 211/45, 49.1, 50; 482/148

(56) References Cited

U.S. PATENT DOCUMENTS 2,671,566 A * 3/1954 Levy ..... 211/45
3,095,834 A * 7/1963 Killen ..... 108/15
6,170,792 B1 * 1/2001 Miceli et al. ..... 248/441.1

* cited by examiner

*Primary Examiner*—Glenn E. Richman

(57) ABSTRACT

A free-standing workout browsing stand to be used with fitness equipment, has two main posts connected by a crossbar sufficiently long that the main posts are at a distance approximately wider than the workout equipment, and a browsing platform connected to the cross bar for displaying material. Two auxiliary posts one each pivotally connected to each of the two main posts, respectively, at the lower portions thereof are added for stability and are further connected by a chain at the lower portions thereof for easy set-up and storage. In addition, the crossbar is adjustable in length so that the distance between the two main posts is thereby adjustable. The crossbar is adjustable along at least a portion of the length of each of the two main posts. The browsing platform is adjustable along the length of the crossbar and is tilt-adjustable about the crossbar.

7 Claims, 3 Drawing Sheets

Perspective view in the general setup

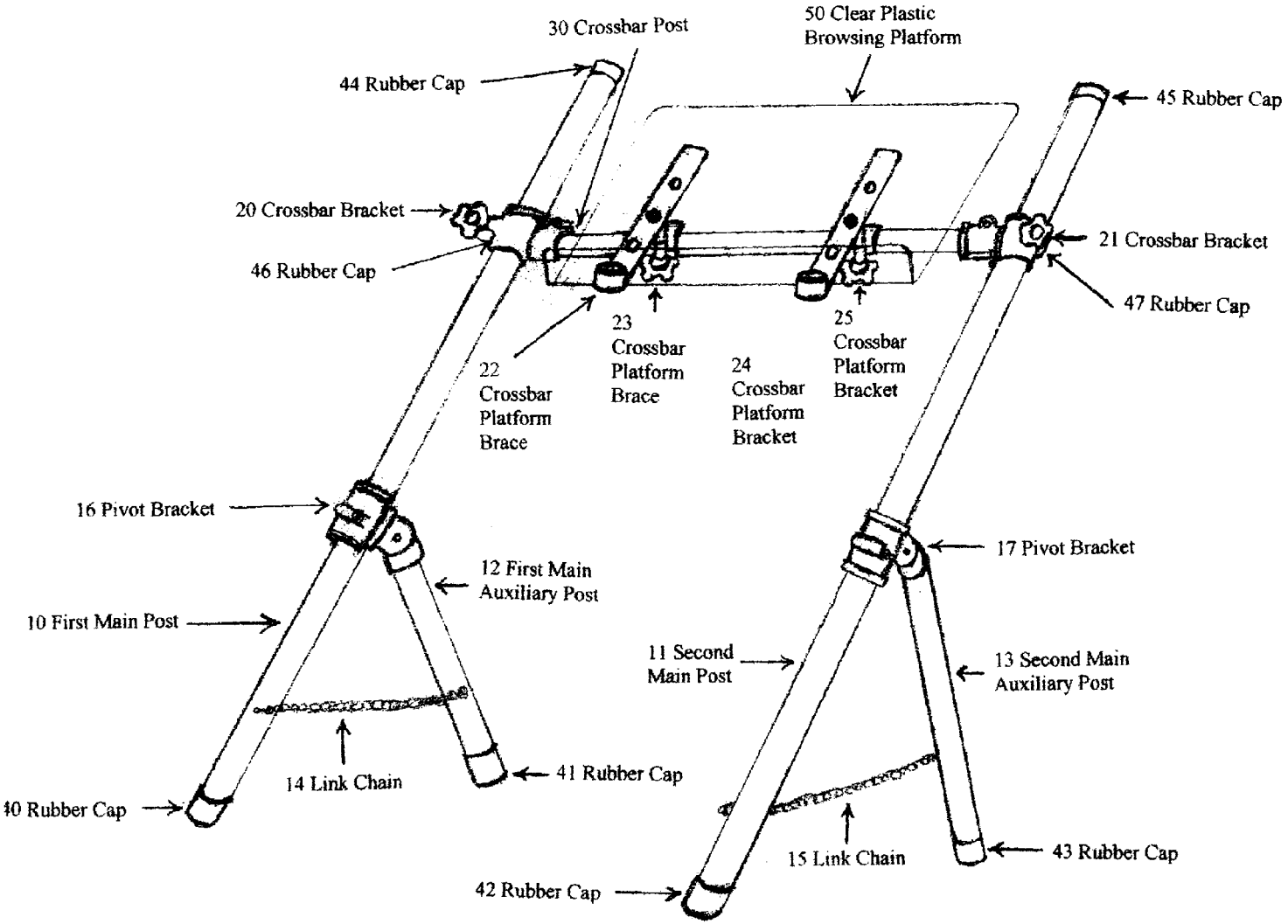
Figure 1 – Perspective view in the general setup

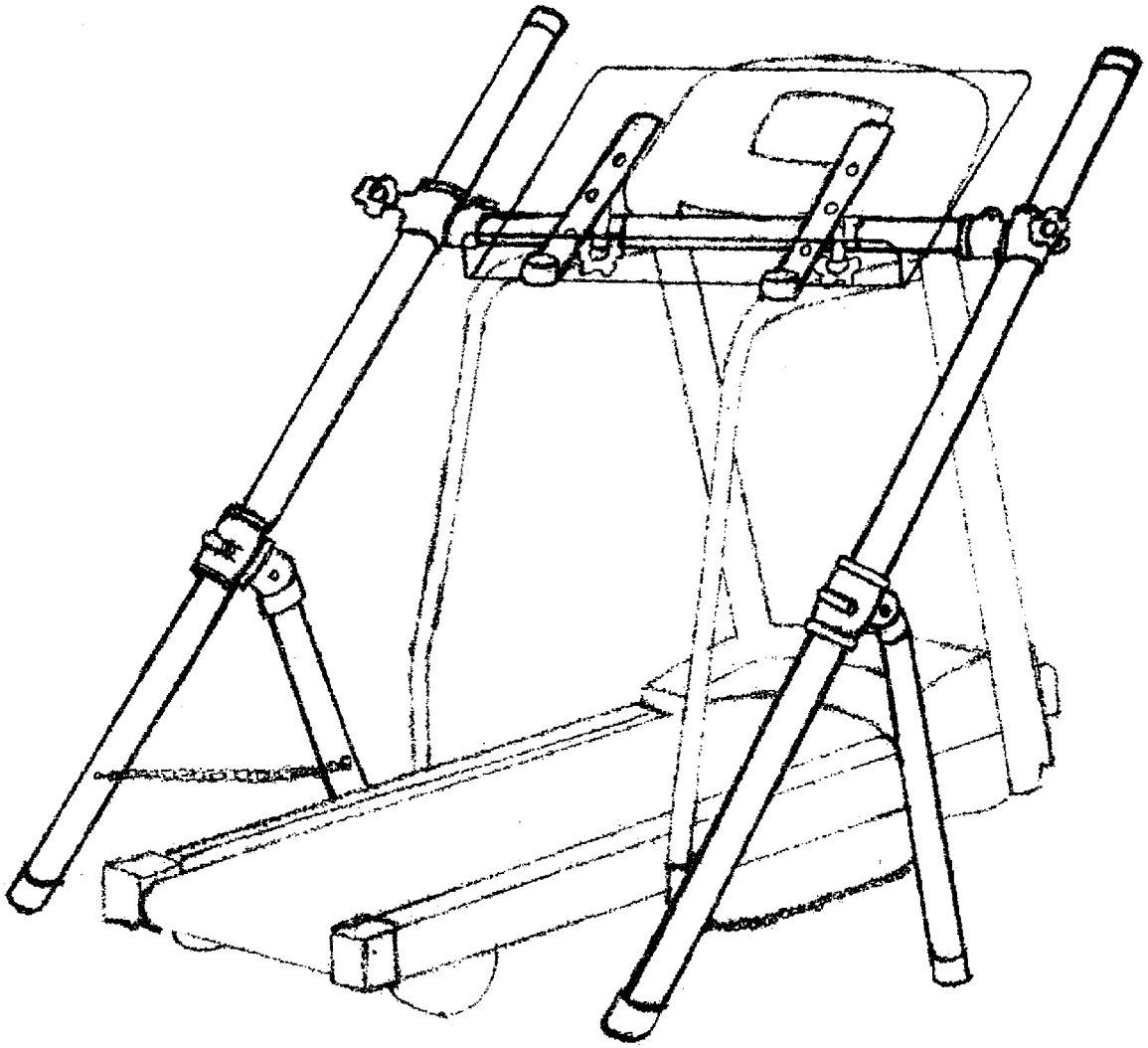
Figure 2-Perspective view in position over a treadmill fitness machine.

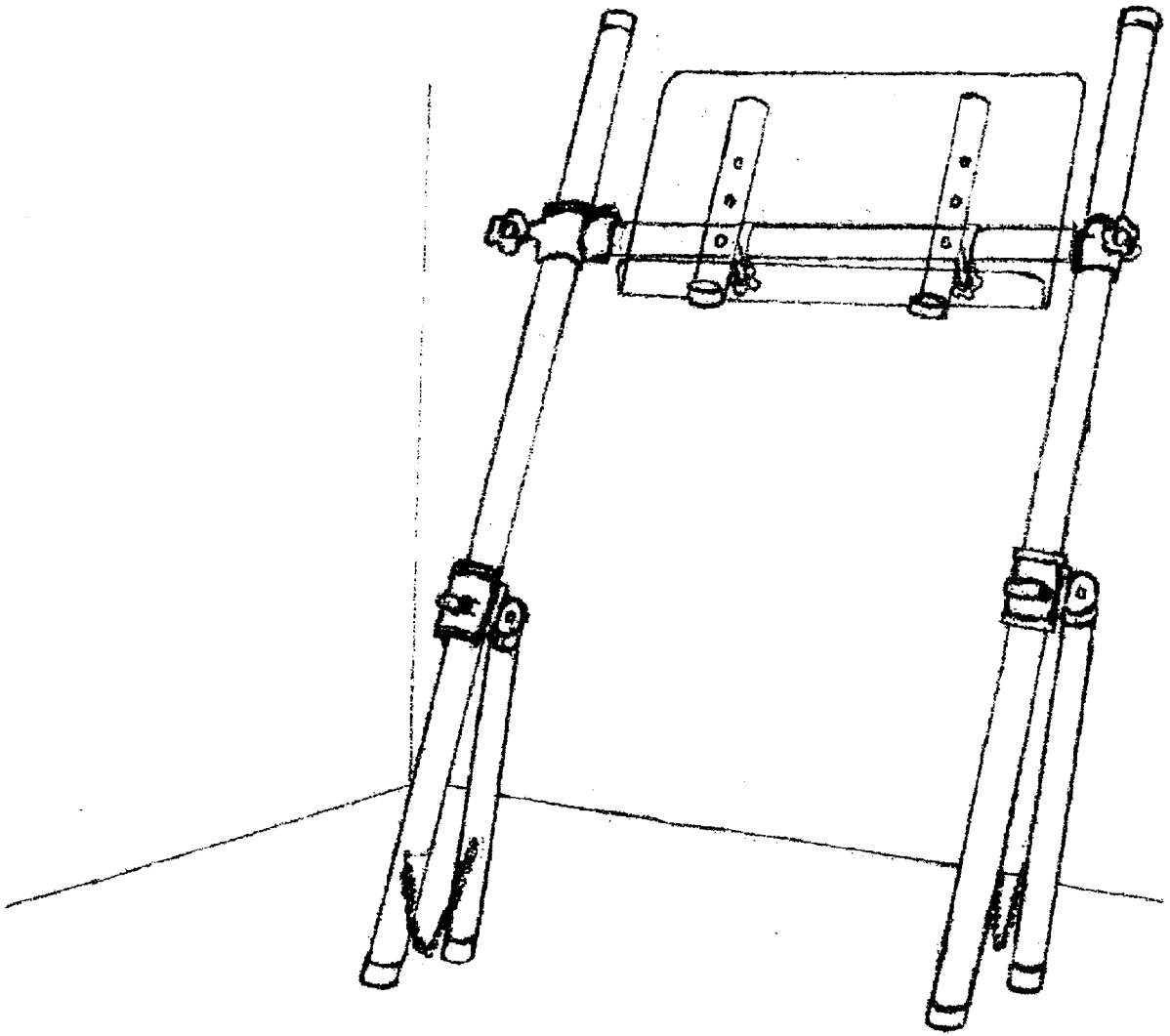
Figure 3-Perspective view resting against a wall when not in use.

WORKOUT BROWSING STAND

BACKGROUND OF THE INVENTION

This invention relates generally to the field of indoor fitness machines, and more particularly to an apparatus for browsing reading material while working out on fitness equipment such as treadmills, stationary bikes, and stationary cross country ski machines.

Trying to have at least a light fitness routine workout in today's fast paced society often takes a backseat to other pressing matters such as trying to read a newspaper, e-mail, review graphics, magazine articles, or searching the Internet. This invention allows combining both functions for the browsing of various media forms while having a workout at the gym or at home.

Plastic reading platforms typically about the size of a large textbook have been attached to the top of a treadmill or stationary bicycle for reading while working out. However, these tend to move with the vibration of the fitness machines resulting in difficulty in reading while working out. In addition, the small size of these platforms generally precludes placing an open newspaper on it to read while working out. Further, the design of these platforms may not allow it to be used with various other fitness machines.

SUMMARY OF THE INVENTION

A primary object of the invention is to provide a workout stand for browsing through reading material while working out.

Another object of the invention is to provide an adjustable height reading platform for various fitness equipment that is unencumbered by the fitness machine.

Another object of the invention is to provide a large base platform to be used without a fitness machine for those who don't want to sit due to a bad back.

Yet another object of the invention is to provide a workout browsing stand that can easily be stored.

In accordance with a preferred embodiment of the present invention, a free-standing workout browsing stand to be used with fitness equipment, the stand comprises two main posts connected by a crossbar sufficiently long that the main posts are at a distance approximately wider than the workout equipment, and a browsing platform connected to the cross bar for displaying material.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 is a perspective view of a workout browsing stand in accordance with a preferred embodiment of the present invention.

FIG. 2 is a perspective view of the workout browsing stand of FIG. 1 in a straddle position over an exemplary fitness machine.

FIG. 3 is a perspective view of the workout browsing stand of FIG. 1 resting against a wall when not in use.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

In accordance with the present invention, FIG. 1 shows an apparatus for browsing reading material, such as newspapers, magazines, graphics, and postal mail, while enabling the person to workout on fitness equipment such as treadmills, stationary bikes, and stationary cross country ski machines. The workout stand is shown in the illustrated embodiment with two, lightweight, sturdy, hollow brushed metal 6' long, 1¼" diameter, first main post 10 and second main post 11. Connected to first main post 10 and second main post 11, about 2½ feet from the lower edge are two similar 3 feet long hollow, brushed metal first and second auxiliary posts 12, 13, respectively. Both sets of first and second main posts 10, 11 and first and second auxiliary posts 12, 13 form the stand and weight bearing portions of the shown embodiment. First and second main posts 10, 11 and first and second auxiliary posts 12, 13 are connected by 20" simple link chain 14, 15, respectively, with self threading metal screws into first and second main posts 10, 11 and first and second auxiliary posts 12, 13 at each end of the chain approximately 10" up from the lower edge. Sturdy plastic pivot bracket 16 attaches to first main post 10 and first auxiliary post 12, and similar sturdy, plastic pivot bracket 17 attaches to second main post 11 with second auxiliary post 13, both with use of an allen-type wrench and bolt. Plastic pivot brackets 16, 17 and link chains 14, 15 permit first and second main post 10, 11 and first and second auxiliary post 12, 13 to easily be swung open for use, and closed, for upright storage against a wall. Both plastic pivot brackets 16, 17 can be slidable on first and second main posts 10, 11, respectively and may thereby adjust for desired vertical pitch of the embodiment.

The bottoms of the first and second main posts 10, 11 and the first and second auxiliary posts 12, 13 have rubber caps 40, 41, 42, 43, that prevent flooring damage from the metal posts and aids in the stability of the entire embodiment. Rubber caps 44, 45 are also shown attached to the top of first and second main posts 10, 11 and rubber caps 46, 47 are shown on the sides of crossbar post 30.

First main post 10 and second main post 11 are connected by one similar lightweight, yet sturdy, hollow brushed metal crossbar post 30 being 4' in length in the preferred embodiment, but may be attached in a variety of ways as is evident for the particular application. Crossbar post 30 may be adjustable in length, thereby adjusting the distance between the two main posts 10, 11, by use of an allen-type wrench and bolt within a hollow tube at the rear of the sturdy plastic crossbar brackets 20, 21 respectively. Sturdy plastic crossbar brackets 20, 21 connect metal crossbar post 30 with a tension adjusting turnwheel each to first main post 10 and second main post 11. The height of metal crossbar post 30 can easily be adjusted up or down on first main post 10 and second main post 11 to accommodate various fitness machine designs and the heights of the users by the use of the tension adjusting turnwheels located on the front of each sturdy plastic crossbar bracket 20, 21.

Snuggly attached to crossbar post 30 are two metal crossbar platform braces 22, 23 with rubber coatings, each approximately 15" in length, approximately 2" wide, ⅜ thick and each with 1½" wide generally L-shaped ledge bottoms. These two metal crossbar platform braces 22, 23 are attached with sturdy, plastic crossbar platform brackets 24, 25 with tension adjusting turnwheels. The turnwheels face the bottom of crossbar post 30 for easy access to adjust crossbar platform braces 22, 23 anywhere from the perpendicular to horizontal position for reading pleasure. Crossbar platform braces 22, 23 also each have three holes for height adjustment with a screw attachment to crossbar platform brackets 24, 25.

A sturdy, free standing, clear plastic browsing platform 50 is shown approximately 30" in length, 20" in height, ⅜" thick, with a 3" wide L-shaped ledge bottom and forms the base for the reading materials for use while working out on a fitness machine. The size of clear plastic browsing platform 50 accommodates various sizes of magazines, textbooks, lightweight laptop computers, a keyboard from a P.C., large newspapers, multiple pages of graphic printouts, etc. Clear plastic browsing platform 50 also allows for direct see through viewing of a P.C. monitor or T.V.

The illustrated embodiment of the present invention is a large clear plastic base platform, and is a freestanding device from the fitness machine as depicted in FIG. 2. As is shown, the work stand is generally positioned straddling the workout equipment.

By way of illustration in FIG. 3, the apparatus is shown easily stored up against a wall when not in use. This process requires no tightening or loosening of parts. The small auxiliary post legs easily tilt back against the large main post legs by way of the plastic pivot brackets devices.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A free-standing workout browsing stand to be used with fitness equipment, the stand comprising:

two main posts connected by a crossbar sufficiently long that the main posts are at a distance approximately wider than the workout equipment, and a browsing platform connected to the cross bar for displaying material.

2. A stand according to claim 1 wherein the crossbar is adjustable in length so that the distance between the two main posts is thereby adjustable.

3. A stand according to claim 1 where in the auxiliary posts are further connected by a chain at the lower portions thereof.

4. A stand according to claim 1 wherein the crossbar is adjustable along at least a portion of the length of each of the two main posts.

5. A stand according to claim 1 wherein the browsing platform is adjustable along the length of the crossbar.

6. A stand according to claim 1 wherein the browsing platform is tilt-adjustable about the crossbar.

7. A stand according to claim 1 wherein the auxiliary posts are adjustable along at least a portion of the main posts.

* * * * *